US010832827B2

(12) United States Patent
Masse et al.

(10) Patent No.: US 10,832,827 B2
(45) Date of Patent: Nov. 10, 2020

(54) IRRADIATING SYSTEM INCLUDING A TARGET-HOLDER MOUNTING IN A RADIATION-PROTECTION ENCLOSURE AND A DEVICE FOR DEFLECTING AN IRRADIATION BEAM

(71) Applicant: P M B, Peynier (FR)

(72) Inventors: Nicolas Masse, Fuveau (FR); Nancy Tannoury, Marseilles (FR); Alain Perez Delaume, Brignoles (FR)

(73) Assignee: P M B, Peynier (FR)

( * ) Notice: Subject to any disclaimer, the term of this patent is extended or adjusted under 35 U.S.C. 154(b) by 165 days.

(21) Appl. No.: 15/557,141

(22) PCT Filed: Mar. 24, 2016

(86) PCT No.: PCT/FR2016/050652

§ 371 (c)(1),
(2) Date: Sep. 11, 2017

(87) PCT Pub. No.: WO2016/151254

PCT Pub. Date: Sep. 29, 2016

(65) Prior Publication Data

US 2018/0047475 A1 Feb. 15, 2018

(30) Foreign Application Priority Data

Mar. 25, 2015 (FR) ..... 15 52510

(51) Int. Cl.
*G21K 5/08* (2006.01)
*G21G 1/10* (2006.01)
(Continued)

(52) U.S. Cl.
CPC ..... *G21K 5/08* (2013.01); *G21G 1/10* (2013.01); *G21K 1/093* (2013.01); *H05H 6/00* (2013.01); *H05H 2006/007* (2013.01)

(58) Field of Classification Search
CPC ..... G21K 5/08; G21K 1/093; G21G 1/10; H05H 6/00
(Continued)

(56) References Cited

U.S. PATENT DOCUMENTS 5,608,224 A 3/1997 Alvord
2007/0085003 A1 4/2007 Miyazaki et al.
(Continued)

FOREIGN PATENT DOCUMENTS

JP H06-196119 A 7/1994
JP 2004-198236 A 7/2004
(Continued)

OTHER PUBLICATIONS

Tang, "Beam transport lines for the CSNS", In Proc of EPAC, pp. 1780-1782. 2006. (Year: 2006).*
(Continued)

*Primary Examiner* — Jack W Keith
*Assistant Examiner* — Daniel Wasil
(74) *Attorney, Agent, or Firm* — Nixon & Vanderhye

(57) ABSTRACT

Disclosed is a system for irradiating a target. The system includes a particle accelerator configured to at least emit an irradiation beam along an axis, a target-holder mounting outside the accelerator, a radiation-protection enclosure surrounding the target-holder mounting, and a deflection device. The particle accelerator is positioned outside the enclosure. The target-holder mounting includes at least one port configured to receive a target holder for a target to be irradiated. The target-holder mounting is stationary relative to the particle accelerator. The port is offset relative to the axis of the irradiation beam. The deflection device is positioned in the radiation-protection enclosure and is configured to divert the irradiation beam towards the port of the target holder in which the target to be irradiated is inserted.

19 Claims, 2 Drawing Sheets

(51) Int. Cl.
*G21K 1/093* (2006.01)
*H05H 6/00* (2006.01)

(58) Field of Classification Search
USPC ..... 376/202
See application file for complete search history.

(56) References Cited

U.S. PATENT DOCUMENTS

| | | | | |
|---|---|---|---|---|
| 2010/0090123 | A1* | 4/2010 | Tajiri | G21K 1/093 250/398 |
| 2010/0329406 | A1* | 12/2010 | Norling | G21G 1/10 376/112 |
| 2012/0223254 | A1* | 9/2012 | Tanaka | G21G 1/10 250/492.3 |
| 2012/0313003 | A1 | 12/2012 | Trbojevic | |
| 2013/0020512 | A1 | 1/2013 | Roy | |

FOREIGN PATENT DOCUMENTS

| | | | |
|---|---|---|---|
| JP | 2006-059513 | A | 3/2006 |
| JP | 2012-531587 | A | 12/2012 |
| JP | 2013-088126 | A | 5/2013 |
| WO | 2010/151412 | A1 | 12/2010 |

OTHER PUBLICATIONS

Conard E M et al: "Operational experience and recent developments at the National Medical Cyclotron, Sydney", Nuclear Instruments & Methods in Physics Research. Section A: Accelerators, Spectrometers, Detectors, and Associated Equipment, Feb. 21, 1996 Elsevier BV * North-Holland, NL—ISSN 0168-9002, vol. A370, No. 2, Feb. 21, 1996, pp. 630-633, XP004006792.

Malay et al.: "Setting up a 30 Mev high current cyclotron facility in Kolkata", Physica Status Solidi C: Current Topics in solid State Physics, vol. 6, No. 11, Nov. 1, 2009, pp. 2376-2379, XP055247018, DE ISSN: 1862-6351.

International Search Report, dated Jun. 30, 2016, from corresponding PCT/FR2016/050652 application.

Office Action issued in Japanese Patent Application No. 2017-549453 dated Dec. 3, 2019 with English translation provided.

* cited by examiner

IRRADIATING SYSTEM INCLUDING A TARGET-HOLDER MOUNTING IN A RADIATION-PROTECTION ENCLOSURE AND A DEVICE FOR DEFLECTING AN IRRADIATION BEAM

BACKGROUND OF THE INVENTION

Field of the Invention

The present application concerns a target irradiation system, and in particular an irradiation system comprising a particle accelerator.

Description of the Related Art

Particle accelerators are pieces of equipment the object of which is to produce beams characterized firstly by the nature of the particles (protons, electrons, etc.), the energy of the particles and the beam current. According to the application for which the accelerator is used (production of radioisotopes, radiotherapy by x-rays or gamma rays, production of neutrons, etc.) the beam may interact with different types of target, for example principally:

Targets in the core of which nuclear reactions take place, for example such as the targets used with cyclotrons for the production of radioisotopes for Positron Emission Tomography (PET);

Stopping block targets the object of which is to stop and characterize the beam at the time of the adjustment phases of the accelerator.

The interaction between the beam and the target may give rise to different types of reaction and therefore to different types of radiation from the target.

As a matter of fact, an irradiated target in turn typically emits radiation comprising in particular neutrons and photons at high energy, typically in the form of x-rays or gamma rays. These neutrons and photons are said to be "primary" when they are produced directly by the nuclear reaction which takes place in the target and "secondary" when they arise from the reactions between the primary photons and neutrons and the surrounding matter.

A cyclotron is a particle accelerator frequently used in medical imaging for the production of radioactive isotopes with a very short half-life, or even of a half-life equal to or less than two hours for example such as the following elements: $^{18}F$ (fluorine 18): 109.7 minutes, $^{68}Ga$ (gallium 68): 67.7 minutes. $^{11}C$ (carbon 11): 20.4 minutes. Other types of particle accelerators may of course be envisioned for example such as a linear accelerator (LINAC) or a synchrocyclotron.

For example, a cyclotron producing a proton (p) beam at 2 MeV and 20 μA (microamperes) interacting with a target comprising water enriched with $^{18}O$ (oxygen 18) to 95% produces $^{18}F$ (fluorine 18) accompanied by a flux of neutrons (n) and photons in a certain proportion, for example typically $6*10^{11}$ G/s (gamma per second) and $4*10^{11}$ n/s (neutrons per second). This reaction is for example notated: $^{18}O \rightarrow {}^{18}F+n$.

According to another example, the interaction between the same beam of protons (p) but this time with a target comprising $^{14}N$ (nitrogen 14) will produce $^{11}C$ (carbon 11) and high energy neutrons and photons, but in different proportions to those of the preceding reaction, for example typically $1*10^{12}$ G/s and $2*10^{9}$ n/s at 20 μA.

The cumulative dose rate near the targets is thus considerable (several Sv (Sievert, with 1 Sv=1 $m^2.s^{-2}$=1 $J.kg^{-1}$) per second in contact with a target for producing $^{18}F$ and a beam of 20 μA protons at 12 MeV (megaelectronvolt)). These intense radiations are ionizing and thus dangerous for humans and the environment. The intensity of these radiations is approximately a million times greater than that of the radiation emitted by a cyclotron with an external source of ions producing the beam described above, that is to say with 20 μA protons at 12 MeV. In the case of a cyclotron with an internal source of ions, the radiation emitted by the acceleration of the ions in the cyclotron is greater, which reduces this ratio by the order of a million between the radiation intensities of a cyclotron and of a target, but the target remains the main radiation source.

In the example cited above, the energy spectrum of the particles emitted by the accelerator possesses a maximum located on average around 2 MeV; there are thus particles which can be emitted at higher energies. The radiation from the targets may in turn interact with items in the surroundings (air, equipment, walls, etc.) and activate those items. Depending on the materials used for the target holder, radioactive isotopes with a half-life that is short or even long (that is to say with a half-life of at least 100 days, or even a few years) may be created, which represents a drawback for this type of technology.

It is thus important to protect persons and the surroundings from the ionizing radiation to limit the risks of irradiation and activation of the items of the surroundings in operation of the accelerator. In particular, persons and the surroundings should be protected from the radiation from the target.

In order to protect persons and the surroundings from this ionizing radiation, such systems are often installed in hot cells that are heavy, bulky and expensive. As a matter of fact, the walls of a hot cell are generally very thick: of the order of 2 meters thickness of concrete.

However, it is not always possible to construct a hot cell in existing installations, such as in a hospital department for example.

The development of certain applications is therefore hindered by constraints associated with the possibilities of installing these irradiation systems.

To reduce this bulk, particle accelerators are sometimes equipped with a chamber for radio protection referred to as "local". This makes it possible to reduce the flux of radiation in the hot cell but not to dispense with a hot cell.

By way of example for such radiation protection, in order to attenuate at least the primary and/or secondary high energy photons coming from the target, it is for example worthwhile to use so-called "dense" materials. Concrete and lead are often used as "dense" materials in particular for reasons of cost and ease of implementation. However, in the interest of compactness and mass reduction, it may be advantageous to use materials that are still more dense, for example such as tungsten.

The attenuation of neutrons is possibly carried out in two steps, i.e. for example, in a first phase, slowing the neutrons, then, in a second phase, trapping the neutrons. The neutrons are for example slowed by elastic impacts with material. Hydrogenated compounds (water, certain polymers, etc.) are for example well-adapted to slow the neutrons. Once the neutrons have been slowed, they are for example trapped by a "neutron trap" or "neutron poison". Boron may for example be used to capture the neutrons. One solution consists for example of adding a few percent of boron, typically 1% to 8% (atomic) as a filler to a hydrogen-rich material, for example such as polyethylene. In the context of the present application, "rich" means that the amount of hydrogen is equal to or greater than approximately 30% or even 40% atomic concentration in the filled material.

However, the capture of neutrons in turn generates so-called "secondary" high energy photons which must in turn be attenuated.

Thus, to attenuate these different radiations, a radiation protection chamber for a target such as a target for producing $^{18}F$ comprises for example a succession of layers of material rich in hydrogen comprising a neutron poison and layers of dense material.

In order to attenuate both primary and secondary high energy photons and neutrons, these functions may possibly be combined, for example by adding boron and a dense material such as lead or tungsten, as fillers to a resin.

Furthermore, as the targets are generally positioned in the immediate vicinity of the acceleration zone, or are even mounted directly at the outlet from the particle accelerator used, the radiation protection chamber thus encompasses both the target and the particle accelerator.

It follows that such a radiation protection chamber does not therefore prevent the radiation coming from the target from significantly activating the particle accelerator and that the mass of the radiation protection remains high (typically 40 to 80 metric tons for cyclotrons producing protons of 10 to 18 MeV, to which 10 to 20 metric tons are to be added for the particle accelerator itself).

These solutions thus make it possible to reduce the risks associated with the non-remnant radiation but do not protect the accelerator from activation by the radiation coming from the target and, on account of their mass, do not facilitate the installation of the accelerators, or are sometimes even prohibitive for an installation in pre-existing buildings.

To avoid the activation of the particle accelerator by the target, one possibility lies in the fact of offsetting the target at a distance from the accelerator, which thereby makes it possible to dispense with encompassing the particle accelerator within the radiation protection chamber and thereby limit the radiation to as close as possible to the target.

The activation of the accelerator is then much lower when the target is offset and radiation protected than when the target is mounted directly on the accelerator and the assembly is radiation protected.

This also makes it possible to considerably reduce the size, and therefore the mass, of the radiation protection chamber since it may then no longer contain the particle accelerator.

On the other hand, it is still possible for the radiation to follow the irradiation beam emitted by the particle accelerator and activate the interior of the accelerator. This is particularly a hindrance for neutron that "rebound" against the metal surfaces of the accelerator by elastic impact. If the installation constraints cause the construction of thick walls to be avoided, this sending back of neutrons is all the more a hindrance in that it generates a high dose rate by itself.

The use of an offset target thus makes it possible to greatly reduce the radiation protection mass, but risks of irradiating the surroundings linked to such neutron leakage remain.

Furthermore, for certain applications, it may be advantageous to be able to use different targets with a same accelerator.

One solution that may be envisioned is then to move the selected target to face the irradiation beam.

However such a solution generally requires destroying a pre-existing vacuum in the system, changing the target then re-establishing the vacuum before being able to re-use the system.

Furthermore, in order for the irradiation of the target to be as optimal as possible, it is necessary for the target to be positioned facing the beam as much as possible. The effect of this is to create a direct path of leakage for the ionizing radiation (high energy photons and neutrons) from the target towards the cyclotron. This has two consequences. The first is that part of the cyclotron is still capable of being activated. The second is that the neutrons which follow the line of the beam "rebound" by elastic impact on the metal parts of the cyclotron and thus create a secondary radiation source which must be shielded.

Document U.S. Pat. No. 5,608,224 describes for example a device comprising a barrel making it possible to use different targets. Although this solution may enable a change in target without destroying the vacuum, it is directed in parallel to ensuring that the target to irradiate is positioned as well as possible in line with the collimator of the irradiation beam. Such a solution does not therefore enable the problem of neutrons coming back towards the particle accelerator.

BRIEF SUMMARY OF THE INVENTION

The object of the present application is directed to solving the aforementioned drawbacks at least in part.

To that end, according to a first aspect, there is provided an irradiation system for irradiating a target, comprising at least:

- a particle accelerator configured at least to emit an irradiation beam along an axis,
- a target holder mounting, positioned outside the accelerator facing the irradiation beam, comprising at least one port configured to receive a target holder configured to receive a target to irradiate, and
- a radiation protection chamber surrounding the target holder mounting, the particle accelerator being positioned outside the chamber, the system being characterized in that the target holder mounting is fixed relative to the particle accelerator and in that the port is axially offset relative to the axis of the irradiation beam, and in that the system comprises a deflection device, positioned in the radiation protection chamber and configured to deviate the irradiation beam towards the port of the target holder in which the target to irradiate is inserted.

The solution provided here thus consists of using a beam deflection device which enables the beam to be directed towards a target inserted into a target holder mounted on a fixed port and positioned outside the solid angle of leakage of the irradiation beam or making it possible to address one among multiple target holders pre-positioned on different ports. The deflection device thus serves as a target selector, or target changer by analogy.

Preferably, the target mounting comprises at least two ports, for example five ports.

For example, at least one of the ports, or even all the ports, are axially offset relative to the axis of the irradiation beam emitted by the particle accelerator.

According to an example embodiment, the ports are disposed in a same plane.

Furthermore for example, the plane in which the ports are disposed is a horizontal plane.

According to an example embodiment, the ports are disposed within a volume.

It then becomes possible to attain different targets surrounded by a radiation protection while minimizing the leakage paths. Thus the dose rate near the corresponding target holder and the particle accelerator and the activation of the nearby equipment, that is to say the items in the surroundings, are low while having a reduced protection mass.

The radioprotection chamber makes it possible to attenuate the remnant and non-remnant radiation generated by the interaction between the target and the beam and the combination between the use of a beam deflection device and of a radioprotection chamber brought close around the target holders makes it possible to reduce, or even eliminate, the direct leakage paths of radiation from the targets towards the particle accelerator while making it possible to reduce the radioprotection mass, possibly by a factor of 5 to 15, while maintaining effective radiation protection.

For example, the radiation protection chamber comprises an alternating arrangement of at least one layer comprising a dense material and at least one layer comprising a hydrogen-rich material comprising a neutron poison.

For example, the hydrogen-rich material is polyethylene (PE) with a boron filler as neutron poison in an amount of approximately 5% to 7% (atomic).

For example, the dense material is tungsten (W) and/or lead (Pb).

Optionally, the radiation protection chamber further comprises an additional radiation protection part which surrounds the target holders mounted on the target holder mounting. The additional part is for example positioned within a wall of the radiation protection chamber. Such a part is for example fastened on the target holder mounting.

Preferably, with the radiation protection layer positioned closest to the target holders, the additional part if present, is of dense material.

In other words, a layer of radiation protection of the radiation protection chamber near an inside surface of the chamber is a layer of dense material.

In an example embodiment, the radiation protection chamber comprises a wall which comprises an additional thickness of hydrogen-rich material positioned between the radiation protection additional part of the target holders and the innermost layer of dense material.

In an example embodiment given by way of illustration, the radiation protection additional part is of tungsten (W) and is of thickness comprised between approximately 5 cm and approximately 15 cm, for example approximately 6 cm or 11 cm.

The wall of the radiation protection chamber next comprises for example:

- The additional thickness of hydrogen-rich material of a thickness comprised between approximately 5 cm and approximately 15 cm, and is of PE having 5% boron filler;
- The innermost layer of dense material of a thickness comprised between approximately 3 cm and approximately 8 cm, and is of tungsten (W);
- A next layer of hydrogen-rich material of a thickness comprised between approximately 25 cm and approximately 40 cm, and is of PE having 5% boron filler;
- A following layer of dense material of a thickness comprised between approximately 2 cm and approximately 8 cm, and is of lead (Pb); and
- An outermost layer of hydrogen-rich material of a thickness comprised between approximately 15 cm and approximately 30 cm, and is of PE having 5% boron filler.

Such a chamber then comprises four layers and an optional additional thickness, in addition to a possible additional part.

The thickness values are of course given by way of indication in order to evoke an order of magnitude and may vary by a few centimeters, for example by +/−5 cm.

Such a chamber is particularly compact.

An order of magnitude of the thickness of the wall is thus comprised between approximately 50 and approximately 100 cm, in particular between approximately 60 cm and approximately 75 cm.

In a particularly advantageous example, the radiation protection chamber comprises at least one spherical wall.

Such a wall for example has an outside diameter at maximum equal to approximately 3 m (meters), or even 2 m.

According to another example embodiment, the radiation protection chamber comprises at least one wall with a parallelepiped geometry, which enables production costs to be reduced. At least one of its width, length or height dimensions is then possibly at maximum equal to approximately 3 m (meters), or even 2 m.

Such a system thus makes it possible to reduce the risks of exposure to radiation and minimizes the constraints of masses and volumes for the installation of such a system, for example in a hospital environment.

It is however to be noted that there was a high prejudice on the part of the Person Skilled in the Art against the idea of being able to use such a device.

As a matter of fact, in view of the usual energy ranges of the irradiation beam, the deflection device must also employ high energies.

This is all the more notable in that to be able to have a deviation making it possible to avoid as well as possible neutrons going back towards the particle accelerator and to limit the mass of the assembly, it is preferable for the angle of deviation to be the greatest possible relative to the initial axis of the beam, for example at least 5°, or even 10°, for example, comprised between 5° and 175° or between 5° and 40°, and in particular for example between approximately 19° and approximately 38°. Therefore, it is preferable for the deflection device to be positioned closest to the target holder mounting, or even at the entry to the target holder mounting.

Thus, in other words, the deflection device is then advantageously configured to deviate the beam, relative to the axis on which it is emitted by the particle accelerator, through an angle of at least 5°, or even 10°, for example comprised between 5° and 175°, for example between 5° and 40°, and preferably between 19° and 38°.

For this, it is for example configured to emit a magnetic field. For example, the magnetic field has a value between 1 and 2 Tesla (T). According to a particular example, the magnetic field is of the order of 1.4 Tesla.

According to an advantageous example embodiment, the deflection device comprises at least one electromagnetic quadrupole positioned on a path of the irradiation beam, that is to say typically on the axis of emission of the beam by the particle accelerator. The electromagnetic quadrupole comprises for example an electromagnet, or even four electromagnets.

According to preferred examples, the deflection device comprises a single electromagnetic quadrupole, or else two electromagnetic quadrupoles.

Instead of a quadrupole, there is preferably a dipole.

Other deflection devices may also be used according to the type and the energy of the accelerated particles, for example such as an electrostatic deflector for lighter particles (like electrons) and/or of lower energies.

The deflection device is also positioned in the radiation protection chamber. It is to be noted that the deflection device also participates in the radiation protection. For this, it is for example composed of a dense material, for example of copper and/or of iron in particular, which makes it effective for attenuating photons. In the context of a quadrupole, this is for example an iron core surrounded by a copper wire, for example an iron yoke and a copper winding.

This raised an additional prejudice against the exploration of such a solution since such a deflection device then preferably being positioned within the protection chamber, another difficulty could lie in the choice of the configuration of the passage of the supplies necessary for the operation of the deflection device through the protection chamber.

According to an advantageous example embodiment, the passages for the supplies, for example cables or pipes, are chicaned.

Once these prejudices have been overcome, by virtue of such positioning, the deflection device itself participates, in the radiation protection by attenuating the high energy photons.

Furthermore, if the target holder mounting nevertheless comprises a port positioned in alignment on the axis of the beam, the target of the target holder mounted on that port is preferably a target having a source term low in neutrons, that is to say of which the neutron flux is less than 100 smaller than the primary photon flux (for example here approximately $1*10^{10}$ n/s). This may for example be a charge target (that is to say a target which makes it possible to adjust the cyclotron suitable for being irradiated but which does not produce any radioactive products), for example of graphite, for the adjustment, or even possibly a target for producing carbon 11 since the latter radiates relatively few neutrons for a beam such as described above, that is to say of 20 μA of protons at 12 MeV. Thus, it is preferable to mount the target holder containing the least used target and/or that having the lowest source term (a charge target for example) on the port aligned on the axis of the beam.

Such a system furthermore has the advantage of being able to be more reactive than a system with a mechanical target changer. In other words, it is possible to pass the beam from one target to another positioned in two target holders mounted on two different ports more rapidly than with a usual mechanical system and without destroying the vacuum, typically within one second.

According to an advantageous example embodiment, the system comprises a device for adjusting the position of the irradiation beam and a device for adjusting the focus of the irradiation beam, and the position adjusting device and the focus adjusting device are positioned upstream of the deflection device.

In an example embodiment, the deflection device differs from the position adjusting device.

In an example embodiment, the position adjusting device and the focus adjusting device are positioned outside the radiation protection chamber.

In another example embodiment, the position adjusting device and the focus adjusting device are positioned at least partly inside the radiation protection chamber, or even at least partly within the wall of the radiation protection chamber.

In an example embodiment, the position adjusting device and the focus adjusting device are for example conjointly produced by a pair of electromagnetic quadrupoles.

According to still another advantageous example embodiment, the system comprises an automatic module comprising a control module and a command unit, the control unit being configured to integrate information and measurements concerning the position and the focus of the irradiation beam and to send instructions to the command unit, and the command unit being configured to actuate the position adjusting device and/or the focus adjusting device and/or the deflection device in order to optimize an interaction between the irradiation beam and the target to irradiate.

Another object of the invention is a target holder mounting, taken in conjunction with its radiation protection chamber, but without the accelerator. More particularly, this other object is a target holder assembly having a reference direction in which it is adapted to be subjected to an irradiation beam, comprising:

a target holder mounting, adapted to be positioned facing opposite said direction, comprising at least one port configured to receive a target holder configured to receive a target to irradiate, and a radiation protection chamber surrounding the target holder mounting and being passed through by said direction, the assembly being characterized in that the target holder mounting is fixed relative to said direction and in that the port is axially offset relative to that direction, and in that the assembly comprises a deflection device, positioned in the radiation protection chamber and configured to deviate an irradiation beam received in said direction towards the port of the target holder in which the target to irradiate is inserted.

Such an assembly is in particular configured for a system such as defined above, comprising all or some of the features described above.

The direction may be materialized in the radiation protection chamber by a channel along which the radiation protection is reduced, or is even of no significance, for example a hollow channel.

Such a system is thus particularly compact.

By virtue of such a system, it is thus possible to dispense with installing an entire wall between the particle accelerator and the target holders.

Such a system may thus be installed in the room of a building, for example a room of a hospital or research complex, while making it possible to avoid requiring notable architectural adaptation or transformation, that is to say in a room with walls of ordinary construction materials (such as concrete and/or metal reinforcements, etc.).

For example, walls of 40 cm of concrete suffice whereas it was necessary to have 2 m for devices of the prior art.

Such a system, and in particular the radiation protection chamber, is thus independent from the room in which it is then installed.

In other words, such a system is thus configured to be installed in a room of a building.

Another way to define the system is to state that it is disposed in a room, or even in a chamber, which surrounds the entire system, the target holders are then disposed within an additional chamber, the aforementioned radiation protection chamber, such that the system is isolated from an external environment and the target holders are isolated not only from the external environment but also in relation to the particle accelerator which, in such a system, is less activated in comparison with the devices of the prior art. The system thus presents a degree of autonomy.

As it is therefore possible for the system to be installed in a single room, all access to the system is thus facilitated. The system can furthermore be installed more easily.

BRIEF DESCRIPTION OF THE DRAWINGS

The invention, according to an example embodiment, will be well understood and its advantages will be clearer on reading the following detailed description, given by way of illustrative example that is in no way limiting, with reference to the accompanying drawings in which.

DETAILED DESCRIPTION OF THE PREFERRED EMBODIMENTS

Identical parts represented in the aforementioned figures are identified by identical numerical references.

Figure 1:
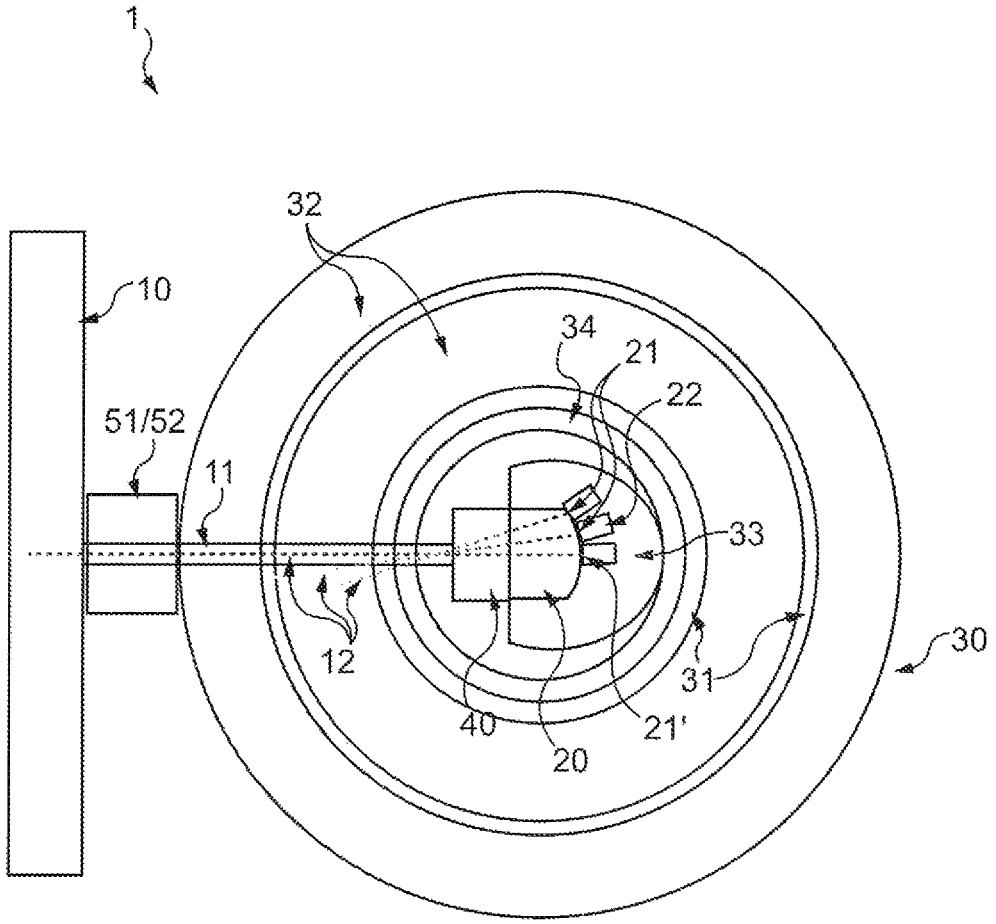
FIG. 1 diagrammatically illustrates a system for irradiating a target according to an example embodiment of the present invention, FIG. 2, composed of FIGS. 2*a* and 2*b*, diagrammatically illustrates examples of geometrical arrangements of the position of the ports.

FIG. 1 presents an irradiation system 1 comprising a particle accelerator 10, a target holder mounting 20 and a radiation protection chamber 30.

The particle accelerator 10 is for example a cyclotron. It is for example configured to emit an irradiation beam 11 comprising a beam of protons of several megaelectrons (MeV).

The radiation protection chamber 30 here surrounds the target holder mounting 20. The particle accelerator 10 is positioned outside the chamber 30.

The radiation protection chamber 30 for example takes the form of a hollow sphere, comprising a wall formed by stacking successive layers.

For example, the wall of the radiation protection chamber 30 comprises an alternating arrangement of a layer of a so-called "dense" material 31 and of a layer hydrogen-rich material 32.

In practice, it is preferable for the radiation protection chamber to comprise at least two layers, for example between two and ten layers, alternately forming a layer of dense material and a layer of hydrogen-rich material.

In order to limit the mass and bulk of the radiation protection, it is furthermore advantageous to position a layer of dense material 31 closest to target holders 22 mounted on the target holder mounting 20, as described later, to firstly attenuate the primary rays.

It is next preferable to alternate layers of hydrogen rich material 32, advantageously comprising neutron poison, with layers of dense material 31 which attenuate the last primary rays as well as the secondary rays arising from the neutron capture.

By way of illustration, in the present example embodiment of FIG. 1, starting from the outermost layer, the wall comprises four layers alternating hydrogen-rich material 32 and dense material 31 such that the innermost layer, that is to say situated closest to the target holders 22 is a layer of dense material 31.

Furthermore here, to reinforce the radiation protection, the target holders 22 mounted on the ports 21 of the target holder mounting 20 are surrounded by a radiation protection additional part 33 which is preferably of dense material. The radiation protection chamber wall then comprises an additional thickness 34 of hydrogen-rich material positioned between the radiation protection additional part 33 of the target holders and the innermost layer of dense material 31.

The hydrogen-rich material 32 is for example polyethylene (PE), optionally with a boron filler as neutron poison in an amount of approximately 5% to 7% (atomic). In the case of a cyclotron bombarding a target for producing $^{18}F$ at 20 μA, digital simulations have shown an optimum attenuation if the PE has a filler of boron in an amount of approximately 7% (atomic).

The dense material 31, which mainly enables the primary and secondary high energy photons to be attenuated, is advantageously of tungsten for example. As tungsten is very dense, it enables a radiation protection chamber to be produced that is more compact and light. As tungsten is however difficult to machine, it may be replaced by other materials such as lead. As lead is less dense than tungsten, replacing the tungsten with lead however slightly increases the diameter of the radiation protection chamber and therefore its mass.

In a preferred example embodiment, the radiation protection additional part 33 is of tungsten (W) and has a thickness of approximately 6 cm. The wall of the radiation protection chamber 30 next comprises:

- The additional thickness 34 of hydrogen-rich material has an inside radius (Ri) of approximately 24 cm and an outside radius (Re) of approximately 30 cm, i.e. a thickness of approximately 6 cm, and is of PE having 5% boron filler;
- The innermost layer of dense material 31 has an inside radius (Ri) of approximately 30 cm and an outside radius (Re) of approximately 35.5 cm, i.e. a thickness of approximately 5.5 cm, and is of tungsten (W);
- The following layer of hydrogen-rich material 32 has an inside radius (Ri) of approximately 35.5 cm and an outside radius (Re) of approximately 64.5 cm, i.e. a thickness of approximately 29 cm, and is of PE having 5% boron filler;
- The following layer of dense material 31 has an inside radius (Ri) of approximately 64.5 cm and an outside radius (Re) of approximately 68.5 cm, i.e. a thickness of approximately 4 cm, and is of lead (Pb); and
- The outermost layer of hydrogen-rich material 32 has an inside radius (Ri) of approximately 68.5 cm and an outside radius (Re) of approximately 88.5 cm, i.e. a thickness of approximately 20 cm, and is of PE having 5% boron filler.

By way of example, if the cyclotron and the target holder mounting described here are used up to one hundred and sixty minutes per day and 23 days per month, it is possible to produce a radiation protection chamber of approximately 6.6 metric tons for an inside radius of 240 mm. Such a radiation protection chamber 30 thus makes it possible to reduce the dose rate outside the walls of 30 cm of ordinary concrete to less than 80 μSv/month, which is the limit set by the EURATOM directives for public areas.

The target holder mounting 20 is positioned facing the irradiation beam 11, in the radiation protection chamber 30.

It comprises several ports 21 each configured to receive a target holder 22, containing when the time comes a target to irradiate, which are axially offset relative to the irradiation beam 11.

Here, in order to simplify the representation, the target holder mounting 20 comprises two ports 21 each with one target holder 22, which are axially offset relative to the irradiation beam 11; as well as an additional port 21' positioned in alignment on the axis of the beam.

As FIG. 1 illustrates, according to the position of the port 21 considered, this makes it possible to reduce to a greater or lesser extent the direct leakage paths 12 that are produced when a target, inserted in the target holder mounted on the port 21 considered, is irradiated by the irradiation beam 11.

When targets of different types are inserted into the ports 21 or 21', it is preferable to position the targets generating the most intense neutron flux in the ports 21 forming the greatest angle with the irradiation beam 11. A target generating less radiation and/or which is less used, such as a charge target, may be inserted in the port 21' that is aligned on the axis of the beam when there is such a port.

For example, starting from the axis of the beam and moving away therefrom, a possible configuration would be to position a charge target in port 21' situated in alignment on the axis of the beam 11, then a target for producing $^{11}C$ then a target for producing $^{18}F$. These targets are thus classified in increasing order of neutron flux generation at a constant current.

It is to be noted that if a port 21 or 21' is left vacant, that is to say that no target is inserted therein, it is preferable to place an obturator therein, forming a fluid-tight plug, in order to better ensure the sealing of the system.

The number of ports 21, or even the existence of a port 21', depends on the needs linked to the application considered.

In the context of applications of PET type, it is advantageous to be able to dispose of at least two target holders, in order to be able to use at least two different targets, for example between two and ten target holders to be able for example to use up to ten different targets. It is thus useful to have as many ports are there are target holders required.

Figure 2A:
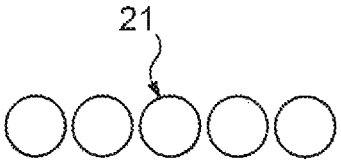
Figure 2B:
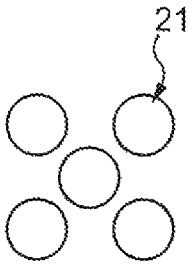

According to the constraints of bulk that exist in the context of the application considered, the ports are for example arranged in a plane as illustrated in FIGS. 1 and 2*a* or in three dimensions, that is to say in a volume, as illustrated in FIG. 2*b*.

To address a target positioned in any one of the target holders of the ports 21 based on the same irradiation beam 11, the system 1 further comprises an irradiation beam deflection device 40, configured to orientate the irradiation beam 11 towards each of the ports 21, for example such that in operation, the protons bombard a target positioned in one of the target holders mounted on one of the ports 21 of the target holder mounting 20.

The deflection device 40 is also positioned in the radiation protection chamber 30. It is to be noted that the deflection device 40 also participates in the radiation protection. For this, it is for example composed of a dense material, for example of copper and/or of iron in particular, which makes it effective for attenuating photons. In the context of a quadrupole, this is for example a core of iron surrounded by a copper wire.

The deflection device 40 comprises for example a deflector comprising for example a quadrupole formed from electromagnets, or preferably a dipole. Such a deflector is then positioned on a path of the irradiation beam 11 and is passed through by it, as FIG. 1 shows diagrammatically. Other deflection devices 40 may also be used according to the type and the energy of the accelerated particles, for example such as an electrostatic deflector for lighter particles (like electrons) and/or of lower energies.

Figure 3:
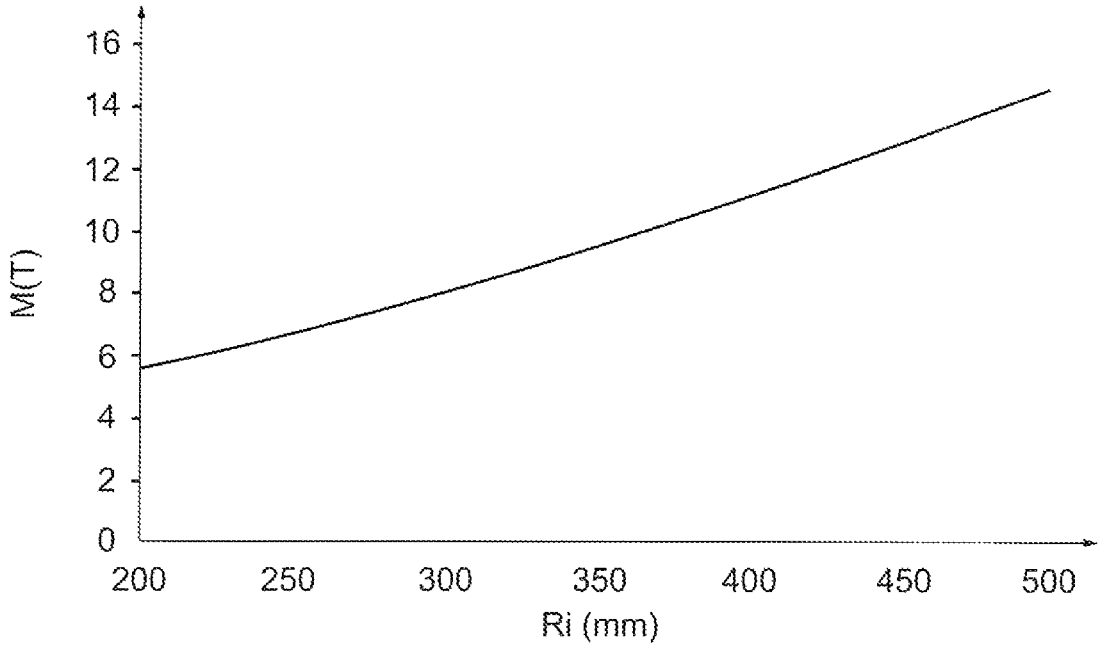
FIG. 3 presents by way of indication a change in the mass M (in metric tons, T) of a radiation protection chamber according to its inside radius Ri (in millimeters, mm)
Figure 4:
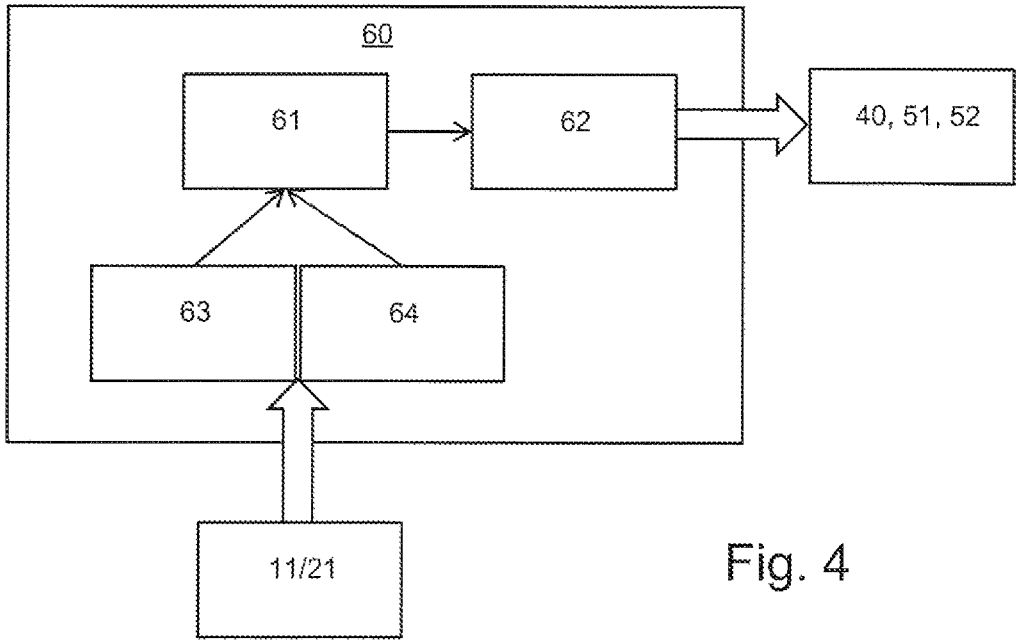
FIG. 4 represents a synoptic diagram of driving a position adjusting device and a focus adjusting device by a control module.

In the case of a three-dimensional arrangement as in FIG. 2*b*, the beam 11 must then be deviated in two dimensions (whereas a deviation only in one dimension is necessary in the context of the arrangement of FIG. 2*a*), which may imply that the deflection device 40 will be more voluminous, inducing an increase in the internal volume of the radiation protection chamber 30, and therefore a greater inside radius Ri of the radiation protection chamber 30, which then increases the mass M of the radiation protection chamber 30, as FIG. 3 illustrates, which may create additional complexity.

The distance between a target holder of a port 21 and the ground at the location at which the system 1 is installed however limits the maximum possible dimension of the radiation protection chamber 30. Thus, it is advantageous to dispose the ports 21 in a horizontal rather than vertical plane.

This furthermore makes it possible to limit the dose rate at the floor and thus more easily install the system 1 above the ground floor of a building for example.

In the present example embodiment, in the interest of compactness, the distance separating the particle accelerator 10 from the target holder mounting 20 is for example very slightly greater than the distance established between a port 21 and the ground.

In order to ensure correct focusing and correct positioning of the irradiation beam 11 at the location of the deflection device 40 and of an entry window of each port 21, the system 1 here comprises an irradiation beam position adjusting device 51 and an irradiation beam focus adjusting device 52.

The deflection device 40 differs from the position adjusting device, in particular in that the deflection device 40 makes it possible to deviate the irradiation beam through angles of at least 5°, whereas a position adjusting device only makes it possible to adjust a position of the point of impact or focal point of the beam, that is to say over scarcely a few tenths of degrees, typically less than 0.5°.

In the present example embodiment, the position adjusting device and the focus adjusting device are mounted upstream of the deflection device 40, it being understood that "upstream" refers here to a direction of emission of the irradiation beam, from the accelerator towards the target holder mounting. They are furthermore both positioned here outside the radiation protection chamber 30; however, they could also be positioned at least partly inside the radiation protection chamber, or even at least partly within the wall.

The position adjusting device 51 and the focus adjusting device 52 are for example conjointly formed by a pair of electromagnetic quadrupoles. However, if the beam diverges sufficiently little, that is to say by typically of the order of less than 0.5°, it is not necessary to use a focus and/or position adjusting device.

To facilitate and increase the reliability of use of such a device, the deflection device 40 is for example modifiable and drivable remotely in order to address a target selected from the multiple targets that can be inserted into each of the target holders 22. In parallel, the position adjusting device 51 and the focus adjusting device 52 of the irradiation beam may also be rendered automatic to optimize the irradiation of the target considered.

For this, the system 1 for example comprises, as is the case here, an automatic control module 60 comprising for example a control module 61 and a command unit 62.

It is then possible to control the position adjusting device 51 and the focus adjusting device 52 in order to perform the positioning in three dimensions of the focal point of the irradiation beam 11 relative to an entry window of the port 21 considered, or even of the port 21'.

A geometric measuring module 63, for example of Beam Position Indicator (BPI) type, is for example possibly used here to send information to the control module 61 concerning the position and the dimensions of the beam 11 at the location of the entry window of the port 21, or even 21', containing the target to irradiate.

A module for measuring current 64 is for example also used to measure the current generated by the beam 11 on the target and communicate the current measurements to the control module 61.

This information and measurements enable the parameters to be adjusted of the devices for adjusting position 51 and focus 52 as well as of the deflection device 40 such that the interaction between the beam 11 and the target are optimal.

For this, the control module 61 integrates the information and measurements supplied by the module 63 and the measuring module 64 and sends instructions to the command unit 62 which actuates the position adjusting device 51 and/or the focus adjusting device 52 and/or the deflection device 40.

The invention claimed is:

1. A target irradiation system, comprising:

a particle accelerator configured to emit an irradiation beam along an axis;

a target holder configured to receive a target that is to be irradiated;

a target holder mounting that is positioned outside the particle accelerator facing the irradiation beam and that is fixed relative to the particle accelerator, the target holder mounting comprising at least two ports axially offset relative to the axis of the irradiation beam, at least one port of the at least two ports being configured to receive the target holder that is configured to receive the target that is to be irradiated;

a radiation protection enclosure surrounding the target holder mounting, the particle accelerator being positioned outside the enclosure, the radiation protection enclosure comprising an alternating arrangement of at least one layer comprising a first material and at least one layer comprising a hydrogen-rich material comprising a neutron poison, the radiation protection enclosure having a wall thickness less than 100 cm; and a deflection device that is positioned in the radiation protection enclosure and configured to deviate the irradiation beam towards the at least one port of the at least two ports of the target holder mounting receiving the target holder in which the target to be irradiated is inserted.

2. The system according to claim 1, wherein the first material is a layer of radiation protection of the radiation protection enclosure near an inside surface of the enclosure.

3. The system according to claim 1, wherein the hydrogen-rich material is polyethylene (PE) with a boron filler as neutron poison in an amount of approximately 5% to 7% (atomic).

4. The system according to claim 1, wherein the first material is tungsten and/or lead.

5. The system according to claim 1, wherein the radiation protection enclosure further comprises a radiation protection additional part which surrounds the target holder, within a wall of the radiation protection enclosure.

6. The system according to claim 5, wherein the radiation protection additional part is of the first material.

7. The system according to claim 5, wherein the radiation protection enclosure comprises a wall which comprises an additional thickness of hydrogen-rich material positioned between the radiation protection additional part and the innermost layer of the first material.

8. The system according to claim 7, wherein the radiation protection additional part is of tungsten (W) and is of a thickness comprised between approximately 5 cm and approximately 15 cm, and wherein the wall of the radiation protection enclosure further comprises:

the additional thickness of hydrogen-rich material of a thickness comprised between approximately 5 cm and approximately 15 cm, and being of PE having 5% boron filler, the innermost layer of the first material of a thickness comprised between approximately 3 cm and approximately 8 cm, and being of tungsten (W), a next layer of hydrogen-rich material of a thickness comprised between approximately 25 cm and approximately 40 cm, and being of PE having 5% boron filler, a following layer of the first material of a thickness comprised between approximately 2 cm and approximately 8 cm, and being of lead (Pb), and an outermost layer of hydrogen-rich material of a thickness comprised between approximately 15 cm and approximately 30 cm, and being of PE having 5% boron filler.

9. The system according to claim 1, wherein the deflection device is configured to emit a magnetic field having a value between 1 and 2 Tesla (T).

10. The system according to claim 1, wherein the deflection device comprises at least one electromagnetic quadrupole positioned on a path of the irradiation beam.

11. The system according to claim 1, wherein the deflection device is composed of one or both of copper and iron.

12. The system according to claim 1, wherein the at least two ports comprise at least three ports disposed in a same plane.

13. The system according to claim 12, wherein the plane in which the ports are disposed is a horizontal plane.

14. The system according to claim 1, wherein the target holder mounting comprises at least three ports disposed in a volume differently from being disposed in a same plane.

15. The system according to claim 1, further comprising:

a position adjusting device configured to adjust the position of the irradiation beam; and a focus adjusting device configured to adjust the focus of the irradiation beam, wherein the position adjusting device and the focus adjusting device are positioned upstream of the deflection device.

16. The system according to claim 15, wherein the deflection device differs from the position adjusting device.

17. The system according to claim 15, wherein the position adjusting device and the focus adjusting device are positioned outside the radiation protection enclosure.

18. The system according to claim 15, wherein the position adjusting device and the focus adjusting device are conjointly formed by a pair of electromagnetic quadrupoles.

19. The system according to claim 15, further comprising an automatic module comprising a control module and a command unit, the control unit being configured to integrate information and measurements concerning the position and the focus of the irradiation beam and to send instructions to the command unit, the command unit being configured to actuate one or more of the position adjusting device, the focus adjusting device, and the deflection device to optimize an interaction between the irradiation beam and the target to irradiate.

* * * * *